US007571971B2

(12) United States Patent
Schulmeister

(10) Patent No.: US 7,571,971 B2
(45) Date of Patent: Aug. 11, 2009

(54) METHOD FOR PRINTING A PRINT FABRIC

(75) Inventor: Peter Schulmeister, Pfaffenhofen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 224 days.

(21) Appl. No.: 11/767,310

(22) Filed: Jun. 22, 2007

(65) Prior Publication Data

US 2008/0001982 A1 Jan. 3, 2008

(30) Foreign Application Priority Data

Jun. 24, 2006 (DE) ..... 10 2006 029 088

(51) Int. Cl.
*B41J 29/38* (2006.01)

(52) U.S. Cl. ..... 347/14; 347/20

(58) Field of Classification Search ..... 347/9, 347/12, 14, 20

See application file for complete search history.

(56) References Cited

U.S. PATENT DOCUMENTS

| | | | |
|---|---|---|---|
| 6,533,385 | B1 | 3/2003 | Mackay et al. |
| 7,448,706 | B2 * | 11/2008 | Yamanobe ..... 347/5 |

FOREIGN PATENT DOCUMENTS

| | | |
|---|---|---|
| DE | 43 40 164 A1 | 6/1995 |
| DE | 197 45 136 A1 | 4/1998 |
| DE | 100 57 061 C1 | 5/2002 |
| EP | 1 426 190 A1 | 6/2004 |
| JP | 60-147348 | 8/1985 |
| JP | 9-201955 | 8/1997 |

* cited by examiner

*Primary Examiner*—Thinh H Nguyen
(74) *Attorney, Agent, or Firm*—Crowell & Moring LLP

(57) ABSTRACT

A method for the printing of a print fabric is disclosed. Output data, more preferably an output matrix of a print image to be printed with an inkjet printing device is converted to target data, more preferably a target matrix, for controlling the inkjet printing device in real time dependent on a current printing speed, a current drop frequency of the inkjet printing head of the inkjet printing device, and a current inclination angle of the nozzle row of the inkjet printing head relative to the transport direction of the print fabric prior to transmitting the data to the inkjet printing device.

20 Claims, 3 Drawing Sheets

METHOD FOR PRINTING A PRINT FABRIC

This application claims the priority of German Patent Document No. 10 2006 029 088.7, filed Jun. 24, 2006, the disclosure of which is expressly incorporated by reference herein.

BACKGROUND AND SUMMARY OF THE INVENTION

The invention relates to a method for the printing of a print fabric.

In form based printing machines preferably operating according to the offset printing principle such as for example in web-fed rotary printing presses and in sheet-fed printing presses inkjet printing devices without form are increasingly used which more preferably serve for the individualization of printing products produced via offset printing with, for example, bar codes, numbering or other markings. Such inkjet printing devices have at least one inkjet printing head which can be designed according to the so-called continuous inkjet principle, the drop-on-demand inkjet principle, the thermal inkjet principle, the bubble inkjet principle or any other inkjet principle. The inkjet printing heads usually have a nozzle row of several nozzles arranged next to one another by way of which the printing ink can be directed at a print fabric to be printed.

Since the maximum printing speed of inkjet printing devices is significantly lower than the maximum printing speed of offset printing devices, in-line printing of a print fabric according to offset printing and according to inkjet printing poses difficulties. To increase the printing speed of inkjet printing devices that can be achieved it is already known from practice to use inkjet printing devices with a multiplicity of inkjet printing heads, namely on the one hand with several inkjet printing heads across the transport direction of the print fabric or the print direction and on the other hand with several inkjet printing heads in transport direction of the print fabric or in printing direction, wherein the multiplicity of inkjet printing heads are arranged next to one another array-like or matrix-like.

The number of inkjet printing heads required across the printing direction is primarily defined by the desired print resolution relative to the given print resolution of the inkjet printing head used and by the desired overall printing width relative to the given printing width of an inkjet printing head. The required number of inkjet printing heads in printing direction is primarily determined by two points, namely firstly in that the desired printing speed is greater than the given printing speed of an inkjet printing head and on the other hand in that several printing inks are to be applied to a print fabric via the inkjet printing device.

Independent of whether an inkjet printing device with several inkjet printing heads arranged array-like or a single inkjet printing head for printing of a print fabric is used, the printing speed that can be achieved can also be increased in that the, or each, inkjet printing head of an inkjet printing device is obliquely aligned or inclined to the transport direction of the print fabric and thus to the printing direction. The inclination results in that the effective distance of the nozzles across the printing direction or transport direction of the print material is reduced and the print resolution across the printing direction can thus be increased. If the printing speed remains unchanged it is then possible to print with a higher area coverage or optical density. Likewise it is also possible to keep the area coverage or optical density constant while increasing the printing speed.

If, to increase the print resolution and/or to increase the printing speed on inkjet printing devices, work is performed with inkjet printing heads inclined to the printing direction or the transport direction of the print fabric, the output data for an image to be printed with the inkjet printing device provided in a preliminary stage of printing has to be converted according to the given geometrical conditions.

With printing methods known from practice this conversion is carried out in the hardware of the inkjet printing heads which however has the disadvantage that this conversion is valid only for a defined inclination, only for a defined drop frequency and only for a defined printing speed. If for instance the printing speed should change it is not possible to react to this as a result of which distortions ultimately impairing the print quality are obtained for the print image to be printed.

Based on this the present invention is based on the problem of creating a new type of method for printing a print fabric. According to the invention, output data more preferably an output data matrix of a print image to be printed with the inkjet printing device is converted into target data, more preferably a target data matrix for controlling the inkjet printing device in real time dependent on a current printing speed, dependent on a current drop frequency of the, or each, inkjet printing head of the inkjet printing device and dependent on a current inclination angle of the, or each, nozzle row of the, or each, inkjet printing head relative to the transport direction of the print fabric prior to transmitting data to the inkjet printing device.

In terms of the method according to the invention it is provided to perform the conversion of the output data to the target data for controlling an inkjet printing device inclined in printing direction independent of the hardware of the inkjet printing heads of the inkjet printing device. The conversion of the output data to the target data according to the invention accordingly takes place prior to the transmission of image information from the preliminary printing stage to the inkjet printing device and thus between the preliminary printing stage and the inkjet printing device. The conversion of the output data to the target data according to the invention takes place in real time wherein the current printing speed, the current drop frequency and the current inclination angle are variable quantities in the conversion of the output data to the target data.

Because of this, the conversion of the output data to the target data can for example be adapted to a changing printing speed so that a high print quality can be guaranteed with the inkjet printing device even with changing printing speeds.

According to a first advantageous further development of the invention the conversion of the output data to the target data is performed by way of a transformation such that an output data matrix is scaled and sheared in printing direction and across the printing direction. A scaling factor for scaling the output data matrix across the printing direction is determined from the current inclination angle, namely from the ratio of the expansion of the print image across the printing direction with inclined inkjet printing device to the expansion of the print image across the printing direction with non-inclined inkjet printing device. A scaling factor for scaling the output data matrix in printing direction is determined from the current printing speed and the current drop frequency. A shear angle for shearing the output data matrix is determined from the current inclination angle.

According to a second alternative advantageous further development of the invention the conversion of the output data to the target data is carried out such that an output data matrix is scanned step-by-step dependent on the current inclination angle, the current printing speed and the current drop frequency wherein, then, when one or several nozzle positions of the inkjet printing device impinge on one pixel in an output data matrix, a corresponding pixel is set in a target data matrix.

Preferred further developments of the invention are obtained from the following description. Exemplary embodiments of the invention are explained in more detail by the drawings.

DETAILED DESCRIPTION OF THE DRAWINGS

Figure 1:
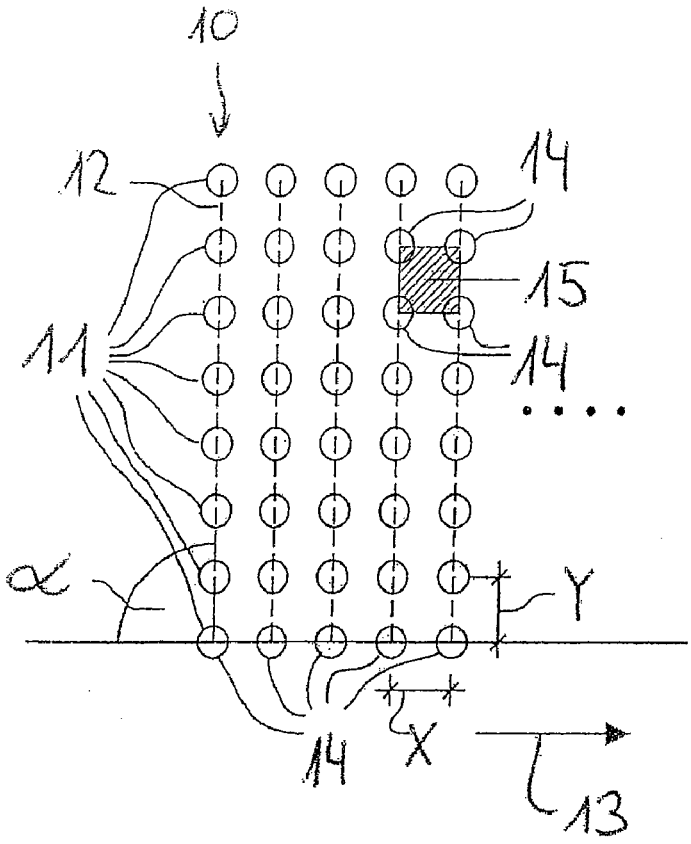
FIG. 1 is a schematic representation to explain the printing conditions with a non-inclined inkjet printing device.

Before the method for the printing of a print fabric according to the invention is described in detail in the following, printing conditions on inkjet printing devices are first described making reference to FIGS. 1 and 2. FIG. 1 shows schematically an inkjet printing head comprising a nozzle row 10 of several nozzles 11 arranged next to one another which are positioned along a row or line 12 with identical distance to one another. The distance of the nozzles 11 of such a nozzle row 10 is predetermined by the technology of the inkjet printing head used.

For printing a print fabric the print fabric to be printed is preferably moved in the direction of the arrow 13 relative to the preferably fixed inkjet printing head wherein for the case of a constant drop frequency of printing ink and a constant printing speed the screen of possible positions 14 for printing ink drops shown in FIG. 1 is obtained. Here, in FIG. 1, the drop frequency, printing speed and the distance of the nozzles are selected such that four adjacent positions 14 of printing ink drops describe a square 15 with a defined surface area. A distance X of the positions 14 in printing direction determines the resolution in printing direction, a distance Y of the positions 14 across the printing direction determines the resolution across the printing direction, wherein in FIG. 1 both these resolutions are identical in size. It is pointed out that the resolution in printing direction can be different in size as can the resolution across the printing direction. From the distance Y of the nozzles 11 across the printing direction multiplied by the number of nozzles 11 the width that can be printed or the extension of a print image that can be printed with the inkjet printing head is obtained, wherein according to FIG. 1 the nozzle row 10 of nozzles 11 includes an angle $\alpha$ of approximately 90° with the printing direction 13. The surface area of the square 15 of FIG. 1 is a dimension for the area coverage or optical density with which printing is possible.

Figure 2:
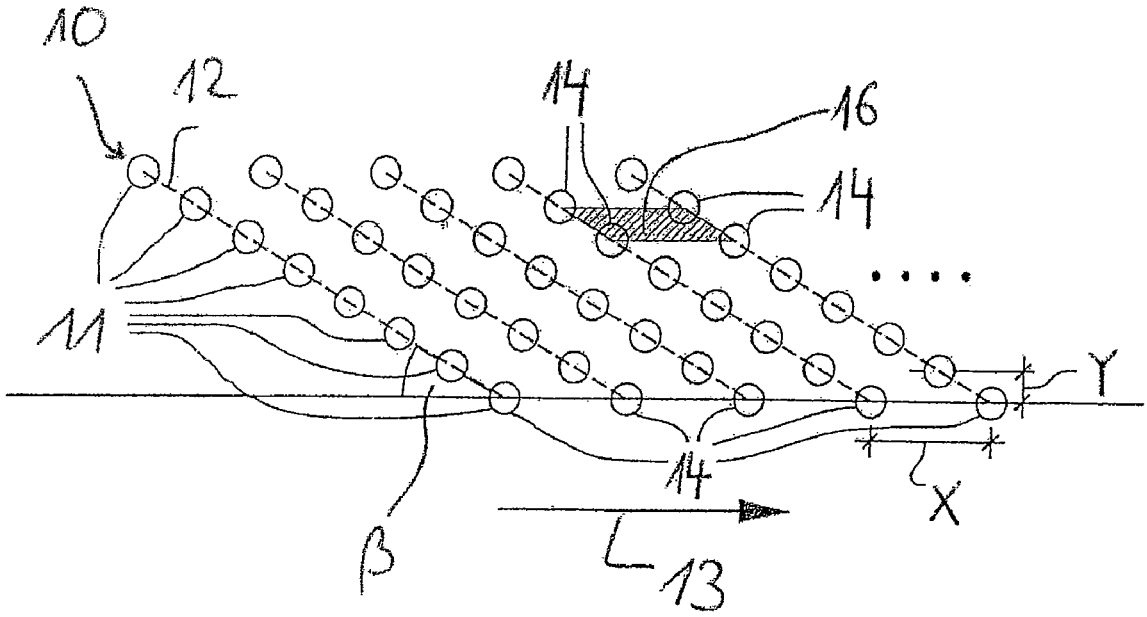
FIG. 2 is a schematic representation to explain the printing conditions with an inclined inkjet printing device.

FIG. 2 explains the printing conditions that materialize if the nozzle row 10 of the nozzles 11 is inclined by an angle $\beta$ relative to the printing direction 13, wherein in FIG. 2 the angle $\beta$ for example amounts to 30°. From this it directly follows that the distance Y of the positions 14 for printing ink drops across the printing direction is reduced as a result of which the resolution across the printing direction can be increased. If in comparison with FIG. 1 printing is to be done with unchanged area coverage or unchanged optical density the distance X between the positions for printing ink drops in printing direction can be increased through increasing the printing speed.

In FIG. 2 the achievable area coverage or achievable optical density is visualized through a parallelogram 16 spread out through four neighbouring positions 14 wherein the area of the parallelogram 16 of FIG. 2 corresponds to the area of the square 15 of FIG. 1.

From the relationships described making reference to FIGS. 1 and 2 it therefore follows that by inclining a nozzle row of an inkjet printing head across the printing direction 13 while maintaining the achievable area coverage or optical density and reducing the printing width and thus extension of the printable print image across the printing direction 13 the printing speed of inkjet printing devices can be increased. This effect is exploited with the method for the printing of a print fabric according to the invention in order to increase the printing speed of inkjet printing devices and thus inkjet printing methods and so to print a print fabric in-line with a form based printing method with an inkjet printing method without a form.

Owing to the inkjet printing heads or nozzle rows of the printing heads being inclined relative to the transport direction of the print fabric and thus the printing direction it is necessary to convert output data of a print image to be printed with the inkjet printing device provided in a preliminary printing stage to target data for controlling the inkjet printing device. In terms of the invention present here this takes place prior to the transmission of data to the inkjet printing device immediately after the provision of the output data in the preliminary printing stage wherein this conversion is dependent on a current printing speed of the printing method based on the form and thus the inkjet printing method, dependent on a current drop frequency of the, or each, inkjet printing head of the inkjet printing device and dependent on a current inclination angle of the, or each, nozzle row of the, or each, inkjet printing head relative to the transport direction and thus the printing direction.

Conversion of the output data to the target data takes place in real time so that during printing with for instance changing printing speed the target data for controlling the inkjet printing device can be changed in order to provide an always optimum print image with the inkjet printing device with changing printing conditions. The current printing speed, the current drop frequency and the current inclination angle are thus variable quantities in the conversion of the output data of the preliminary printing stage to the target data for controlling the inkjet printing device.

As already mentioned, the inclination angle of the, or each, nozzle row of the, or each, inkjet printing head of the inkjet printing device is a variable quantity of the method according to the invention wherein the inclination angle however can be ideally selected so that with a given maximum printing speed and a given maximum drop frequency a geometrical area coverage or optical density of 100% is just provided. Then the maximum printing speed is only limited through physical parameters such as for example the drop frequency itself as well as the placing accuracy of the printing ink drops on the print fabric connected with this. The inclination angle however can be selected so that area coverages of less than 100% are obtained.

The current drop frequency is either equal or variable for all nozzles of an inkjet printing head wherein when a continuous inkjet printing device is used the drop frequency for all nozzles is identical and wherein, if a drop-on-demand inkjet printing device is used, the drop frequency is variable.

The current printing speed is sensed by way of a measuring sensor and constitutes a variable input quantity for the conversion of the output data of the preliminary printing stage for the print image to be printed with the inkjet printing device to the target data for controlling the inkjet printing device.

To convert the output data to the target data according to a first version of the method according to the invention the procedure is to convert the output data via a transformation to the target data, namely such that output data present in form of an output data matrix, more preferably an output bitmap, is scaled and furthermore sheared in printing direction and across the printing direction to provide a target data matrix, more preferably a target bitmap for controlling the inkjet printing device. The detailed procedure with this transformation is explained in the following making reference to FIG. 3 to FIG. 5.

Figure 3:
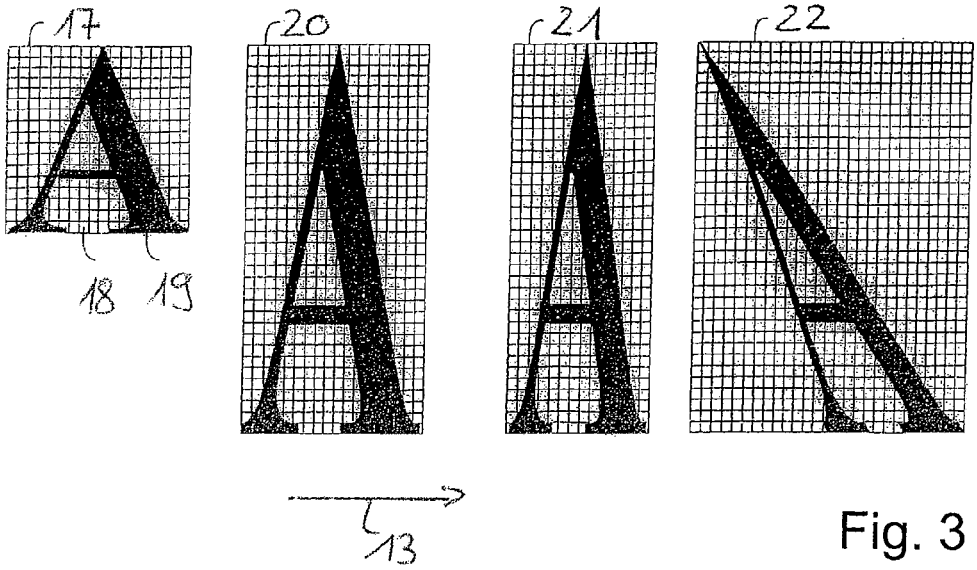
FIG. 3 is a first representation to explain a first version of the method according to the invention.

In FIG. 3 an output data matrix for a print image to be printed with an inkjet printing device provided in a preliminary printing stage is numbered with the reference FIG. 17 wherein this output data matrix 17 is an orthogonal output bitmap which is screened making use of known methods. In the simplest case purely binary data is available per pixel which signifies that a pixel of the output data matrix 17 is either set and thus black or not set and thus white. The print image to be printed, in the exemplary embodiment shown is an A, wherein in FIG. 3 a not-set and thus white pixel with the reference number 18 and a set and consequently black pixel is marked with the reference number 19.

In FIG. 3, scaling of the output data matrix across the printing direction 13 is first performed to convert the output data matrix 17 to a target data matrix wherein a scaling factor for the scaling across the printing direction is obtained from the current inclination angle. In this way the scaling factor for the scaling across the printing direction is obtained from a ratio of the printing width of the inclined inkjet printing head relative to the printing width of the non-inclined inkjet printing head.

Expressed in other words the scaling factor for the scaling across the printing direction is obtained from the ratio of the expansion of the print image across the printing direction with inclined inkjet printing device to the expansion of the print image across the printing direction with non-inclined inkjet printing device. In FIG. 3 a data matrix scaled with this scaling factor is marked with the reference number 20.

In the exemplary embodiment of FIG. 3 this is followed by scaling in printing direction wherein a scaling factor for scaling in printing direction is determined from the current printing speed and the current drop frequency. If the drop frequency is unchanged the scaling factor in printing direction corresponds to the ratio of the printing speed of the inkjet printing head in non-inclined operating mode to the printing speed of the inkjet printing head in inclined operating mode. FIG. 3 numbers a data matrix that is scaled both across the printing direction and also in printing direction with the reference number 21.

In FIG. 3 the above scaling in printing direction as well as across the printing direction is followed by a shearing of the output data matrix, wherein a shearing angle is determined from the current inclination angle. A data matrix which has been scaled by both scaling factors and transformed by the shearing angle which corresponds to the target data matrix for controlling the inkjet printing device is marked in FIG. 3 with the reference number 22. It is pointed out that the sequence of the scalings and the shearing of the output data matrix is random. All transformations can also take place in one step.

Figure 4:
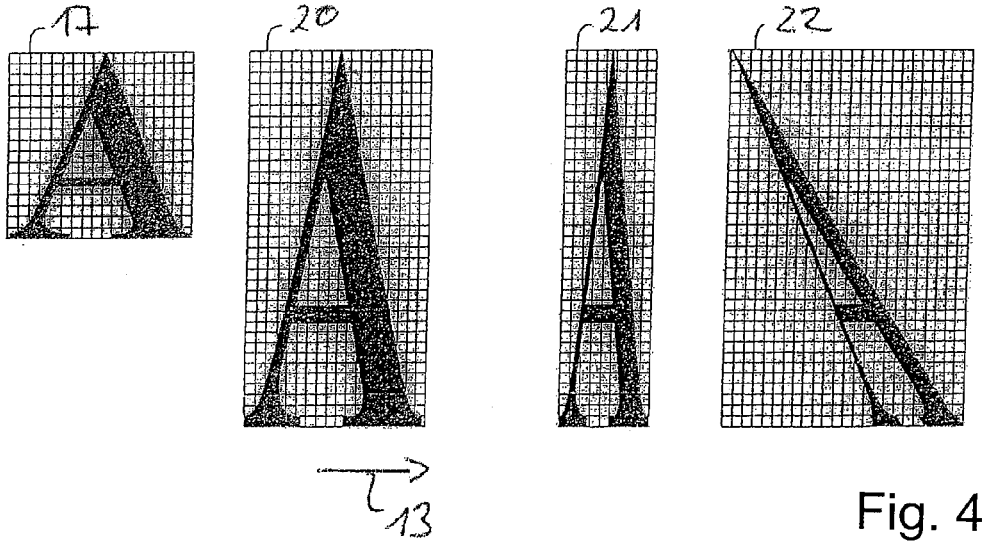
FIG. 4 is a second representation to additionally explain the first version of the method according to the invention.

FIG. 4 visualizes the effects on the transformation of the output data matrix if the printing speed is higher than in the exemplary embodiment of FIG. 3. Otherwise all parameters in the exemplary embodiment of FIG. 4 are unchanged compared with the exemplary embodiment of FIG. 3. By increasing the printing speed different scaling in printing direction is obtained so that the data matrix 21 and thus ultimately also the target matrix 22 are changed compared with FIG. 3. However, since exclusively the printing speed has changed compared with FIG. 3 the scaling factor across the printing direction and the shearing angle remain unchanged.

Figure 5:
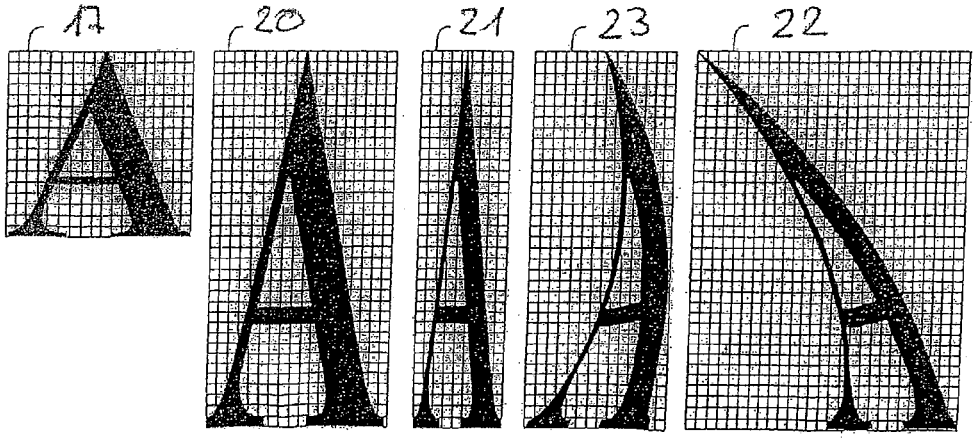
FIG. 5 is a third representation to additionally explain the first version of the method according to the invention.

FIG. 5 visualizes the connections during the transformation of the output data matrix 17 to a target data matrix 22 for the case in which the inkjet printing device is inclined relative to an arched guide element such as for instance a cylinder for the print fabric to be printed. In this case a transformation takes place in addition to the two scalings and the shearing to offset or compensate time delay differences of the printing ink drops to the print fabric caused by the different distance of the nozzles of the, or each, inkjet printing head of the inkjet printing device. In FIG. 5 this transformation to offset the different distances of the nozzles to the print fabric between the scaling in printing direction and the shearing takes place, while the sequence, here, is random as well. In FIG. 5 a data matrix scaled in both directions and transformed for offsetting the different nozzle distances is marked with the reference number 23, wherein the target data matrix 22 is additionally sheared by the shearing angle.

To compensate the time delay differences of the printing ink the preferable procedure is that the output data of the print image to be printed is adapted such that such print image information which is assigned to nozzles with a larger distance from the print fabric to be printed compared with such print image information which is assigned to nozzles with a smaller distance from the print fabric to be printed is displaced to an earlier position in printing direction.

A second version of the method according to the invention for converting the output data of the preliminary printing stage to the target data for controlling the inkjet printing device is described in the following making reference to FIGS. 6 to 8, wherein this conversion of the output data to the target data is performed according to the second version in that an output data matrix dependent on the current inclination angle, the current printing speed and the current drop frequency is scanned step-by-step wherein then, when one or several nozzle positions of the inkjet printing device impinge on one pixel in the output data matrix, a corresponding pixel is set in the target data matrix.

Figure 6:
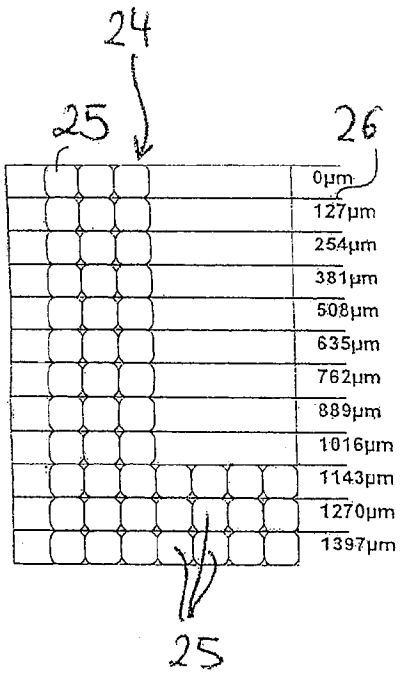
FIG. 6 is a first representation to explain a second version of the method according to the invention.

FIG. 6 shows an output data matrix 24 of 8×12 pixels as an example for an L to be printed with the help of an inkjet printing device, wherein pixels set for printing are shown as rounded squares 25 in FIG. 6. In the representation of FIG. 6 200 dpi is assumed as resolution for the output data matrix 24 in both directions of the matrix so that a screen width 26 by 127 μm is obtained in both directions.

Figure 7:
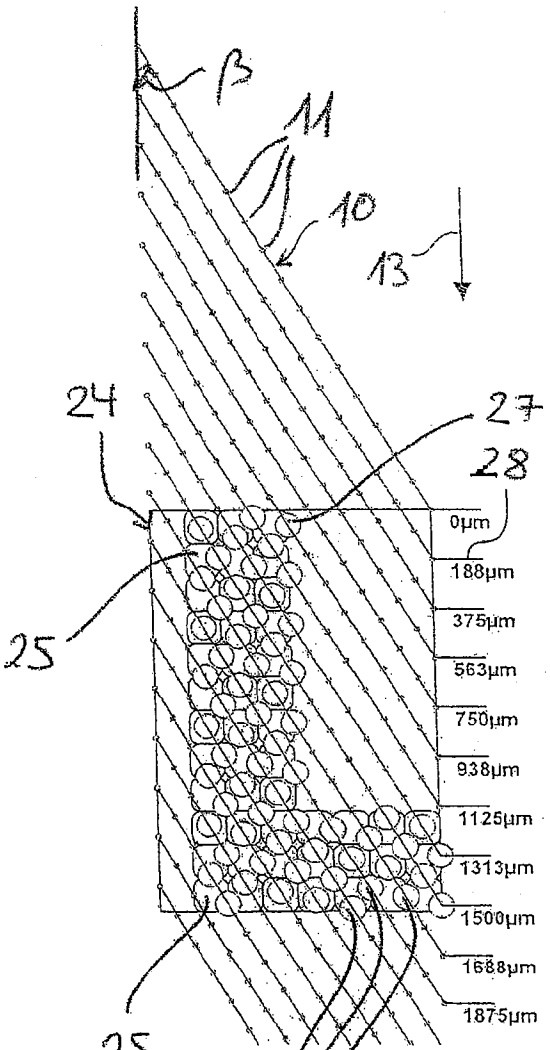
FIG. 7 is a second representation to further explain the second version of the method according to the invention.

This output data matrix 24 of the FIG. 6 is virtually scanned according to FIG. 7 assuming an inclination angle β of a nozzle row 10 of nozzles 11 relative to the printing direction 13, wherein then, when one or several nozzle positions 11 impinge on a set pixel 25 in the output data matrix, a corresponding pixel 27 is set in the target data matrix. A step width 28 of this scanning, which corresponds to the screen width of the target data matrix, is dependent on the current printing speed and the current drop frequency. The step width of the scanning and thus the screen width of the target data matrix is greater, the greater the printing speed. In FIG. 7, pixels 27 set in the target data matrix are represented as circles which are represented slightly smaller than they could cover in terms of area to guarantee clearer representation.

Figure 8:
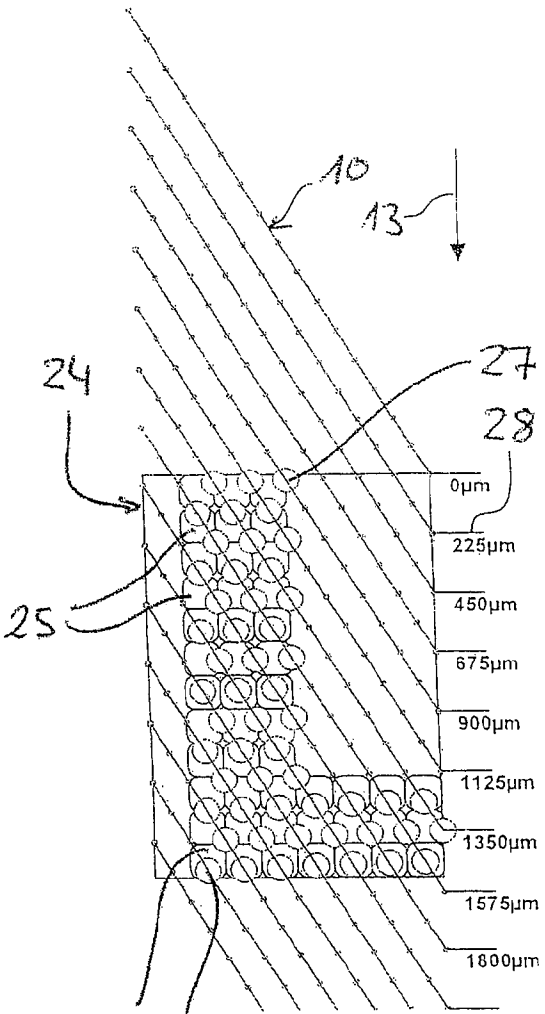
FIG. 8 is a third representation to further explain the second version of the method according to the invention.

In FIG. 8 the step width of the scanning or the screen width 28 of the target data matrix is increased compared with FIG. 7 by increasing the printing speed with constant drop frequency, wherein in FIG. 8 the pixels 27 of the target data matrix roughly have the same dot density as the pixels 25 of the output data matrix. From this it follows that printing can be performed with almost unchanged optical density if the printing speed is increased.

The setting of the pixels in the target data matrix can take place in a binary way or via grey value modulation. Then, when the inkjet printing device uses inkjet printing heads that operate in a binary manner, pixels which all have the same drop size are set or not set in the target data matrix, specifically dependent on whether during the scanning nozzle positions impinge on pixels in the output data matrix. If however an inkjet printing device is used whose inkjet printing heads can modulate grey values, at a time, when a nozzle position impinges on a pixel in the output data matrix, the grey value which comes closest to the ratio of the area coverage of a printing ink drop and the imaginary pixel area in this position is set in the target data matrix.

Even according to the second version of the present invention, the target data matrix generated using the method described making reference to FIGS. 6 to 8 can be converted or transformed for compensation of different distances of the nozzles from the print fabric to be printed as described making reference to FIG. 5.

The conversion of output data to target data described above is carried out in real time so that a speed change of the printing speed can be taken into account in the inkjet printing device.

A side effect of the method described consists in that with lesser printing speed than the maximum printing speed a higher optical density can be achieved. Especially when printing black/white graphics or when printing texts this side effect has a positive effect on the print image quality. However, if this side effect is perceived as disruptive, the target data matrix can be deliberately thinned out by deleting pixels such that when several pixels are set in a position of the target data matrix, only the best placed pixels are selected in each case.

LIST OF REFERENCE NUMBERS:

10 Nozzle row
11 Nozzle
12 Line
13 Printing direction
14 Position
15 Square
16 Parallelogram
17 Output data matrix
18 Pixel
19 Pixel
20 Data matrix
21 Data matrix
22 Target matrix
23 Data matrix
24 Output data matrix
25 Pixel
26 Screen width
27 Pixel
28 Screen width The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for printing of a print fabric, wherein the print fabric is printed with a form based printing method, as well as in-line with the form based printing method with an inkjet printing method without form, wherein an inkjet printing device for performing the inkjet printing method has an inkjet printing head, which comprises a nozzle row of nozzles arranged next to one another, via which a printing ink is directable at the print fabric to be printed, and wherein the inkjet printing head is aligned relative to the print fabric to be printed such that the nozzle row of the inkjet printing head is inclined relative to a transport direction of the print fabric, wherein output data is converted into target data for controlling the inkjet printing device in real time dependent on a current printing speed of the form based printing method and thus the inkjet printing method, dependent on a current drop frequency of the inkjet printing head of the inkjet printing device, and dependent on a current inclination angle of the nozzle row of the inkjet printing head.

2. The method according to claim 1, wherein the current printing speed of the form based printing method and thus the inkjet printing method is sensed through measuring and is thus a variable input quantity for the conversion of the output data to the target data for controlling the inkjet printing device.

3. The method according to claim 1, wherein the current drop frequency when using a continuous inkjet printing device is a same value for all nozzles of the inkjet printing head or when using a drop-on-demand inkjet printing device is variable for the nozzles of the inkjet printing head.

4. The method according to claim 1, wherein the current inclination angle is selected such that with a maximum printing speed and with a maximum drop frequency a geometrical area coverage of 100% materializes.

5. The method according to claim 1, wherein the conversion of the output data to the target data takes place such that an output data matrix is scaled and sheared in a printing direction and across the printing direction.

6. The method according to claim 5, wherein a scaling factor for scaling the output data matrix across the printing direction is determined from the current inclination angle from a ratio of an expansion of a print image across the printing direction with an inclined inkjet printing device to an expansion of the print image across the printing direction with a non-inclined inkjet printing device.

7. The method according to claim 5, wherein a scaling factor for scaling the output data matrix in the printing direction is determined from the current printing speed and the current drop frequency.

8. The method according to claim 5, wherein a shearing angle for shearing the output data matrix is determined from the current inclination angle.

9. The method according to claim 1, wherein the conversion of the output data to the target data takes place such that an output data matrix is scanned step-by-step dependent on the current inclination angle, the current printing speed and the current drop frequency, wherein then, when a nozzle position of the inkjet printing device impinges on a pixel in the output data matrix, a corresponding pixel is set in a target data matrix.

10. The method according to claim 9, wherein a grey value is set for modulation of grey values in the target data matrix which comes closest to a ratio of an area coverage of a drop and a pixel area in the nozzle position.

11. The method according to claim 9, wherein a step width of the scanning of the output data matrix is dependent on the current printing speed and the current drop frequency, wherein the step width is greater with a greater printing speed.

12. The method according to claim 1, wherein when the inkjet printing device is inclined relative to an arched guide element for print fabric to be printed the nozzle row of the inkjet printing head has a different distance from the print fabric to be printed, the conversion of the output data to the target data takes place such that time delay differences of the printing ink to the print fabric caused through the different distance of the nozzles from the print fabric to be printed are offset or compensated, wherein for this purpose the output data of the print image to be printed are offset or compensated, wherein for this purpose the output data of the print image to be printed is adapted such that such print image information, which is assigned to nozzles with a greater distance from the print fabric to be printed is displaced to an earlier position in the printing direction relative to such print image information which is assigned to nozzles with a shorter distance from the print fabric to be printed.

13. The method according to claim 1, wherein the output data is an output matrix of a print image to be printed with the inkjet printing device and wherein the target data is a target matrix.

14. A method for printing a print fabric, comprising the steps of:

converting output data of a print image to be printed in a preliminary printing stage into target data;

transmitting the target data to an inclined inkjet printing head; and controlling the inclined inkjet printing head based on the target data to print the print fabric;

wherein the conversion of the output data into the target data is dependent on a printing speed, a drop frequency of the inkjet printing head, and an inclination angle of the inkjet printing head.

15. The method according to claim 14, wherein the step of converting is accomplished during a printing operation of the inkjet printing head.

16. The method according to claim 15, wherein the printing speed is changed during the printing operation and wherein the output data is converted into the target data based on the changed printing speed.

17. The method according to claim 14, wherein the printing speed, the drop frequency, and the inclination angle are changeable variables in the converting step.

18. The method according to claim 14, wherein the converting step includes scaling and shearing an output data matrix of the output data.

19. The method according to claim 14, wherein the converting step includes scanning an output data matrix of the output data step-by-step such that when a nozzle position of the inkjet printing device impinges on a pixel in the output data matrix a corresponding pixel is set in a target data matrix of the target data.

20. The method according to claim 19, wherein the corresponding pixel is set in the target data matrix by a binary method or a grey value modulation method.

* * * * *